US005887350A

United States Patent [19]

Porper

[11] Patent Number: 5,887,350

[45] Date of Patent: Mar. 30, 1999

[54] TRIMMING AND SHAPING TOOL FOR BILLIARD CUE STICKS

[76] Inventor: Joseph Porper, 7741 Alabama Ave. Unit 1, Canoga Park, Calif. 91304

[21] Appl. No.: 787,250

[22] Filed: Jan. 24, 1997

[51] Int. Cl.[6] ..... B27L 9/00

[52] U.S. Cl. ..... 30/494

[58] Field of Search ..... 30/494

[56] References Cited

U.S. PATENT DOCUMENTS

| | | | |
|---|---|---|---|
| 94,317 | 8/1869 | Johnson et al. | 30/494 |
| 538,119 | 4/1895 | Olney | 30/494 |
| 4,620,370 | 11/1986 | Zownir et al. | 30/494 |
| 4,785,586 | 11/1988 | Kratfel | 30/494 |
| 4,827,618 | 5/1989 | Lynn | 30/494 |

*Primary Examiner*—Hwei-Siu Payer
*Attorney, Agent, or Firm*—Gilbert Kivenson

[57] ABSTRACT

A compact trimming and shaping tool for preparing cemented-on leather tips on billiard cue sticks is described. Because blades are used for trimming and shaping instead of the usual files and sanding surfaces, the tool can be more rapid and suitable for retipping sticks in a short time.

3 Claims, 1 Drawing Sheet

TRIMMING AND SHAPING TOOL FOR BILLIARD CUE STICKS

BACKGROUND OF THE INVENTION AND PRIOR ART

This invention relates to a compact tool for trimming and shaping leather cue stick ends. It can be employed for reconditioning cue sticks which employ a leather tip as the impact end.

Leather tips have become traditional over many years of play because this tip, when adequately chalked, can be used to impact virtually any exposed surface of the cue ball without slippage. When the ball is struck, it will move foreward while carrying various degrees of top, bottom or side spin so that it carries out certain desired motions after it bounces from a side or end rail. Unfortunately leather flattens out after a relatively brief period of play and must be replaced fairly often.

The prior art teaches many devices and machines for renewing leather tips. Many are large requiring the cue stick to be moved to the machine. Thus the apparatus of Boyle (U.S. Pat. No. 89,624) is an early example of these machines. A device of Porper(U.S. Pat. No. 5,228,160 ) is more compact but still too bulky to be carried in a pocket. A pocket tool by Willard(U.S. Pat. No. 4,594,782) employs a sanding surface to shape the leather and provides a gauge to measure when the correct shape is achieved. Sanding is a slow process however; the processing time for a number of cue sticks is therefore too great.

SUMMARY OF THE PRESENT INVENTION

The present invention can be used by the owner of a billiards or pool room to rapidly prepare a number of cue sticks. The invention can be constructed in the shape of a cylinder with openings at both ends. The operator first removes the old leather tip, cleans the end of the cue stick ferrule ans cements on a new leather blank. This step requires about 10 minutes per stick. After the cement is dry, the end of the stick is inserted in one end of the invention and rotated. This removes the excess cement which has dried between the leather and the ferrule ant trues up the out-of-roundness of the leather blank. The stick is then removed and its end inserted into the other end of the invention and again rotated. This rounds the tip. The cue stick is now ready for chalking and play.

DETAILED DESCRIPTION OF THE INVENTION

The invention will be described with reference to FIGS. 1 and 2. It consists of the cylinder 11 in which openings 12 and 14 have been been drilled. A rectangular slot 15 is milled into one side of the cylinder. A cutting blade 3 and steel bar

Figure 1:
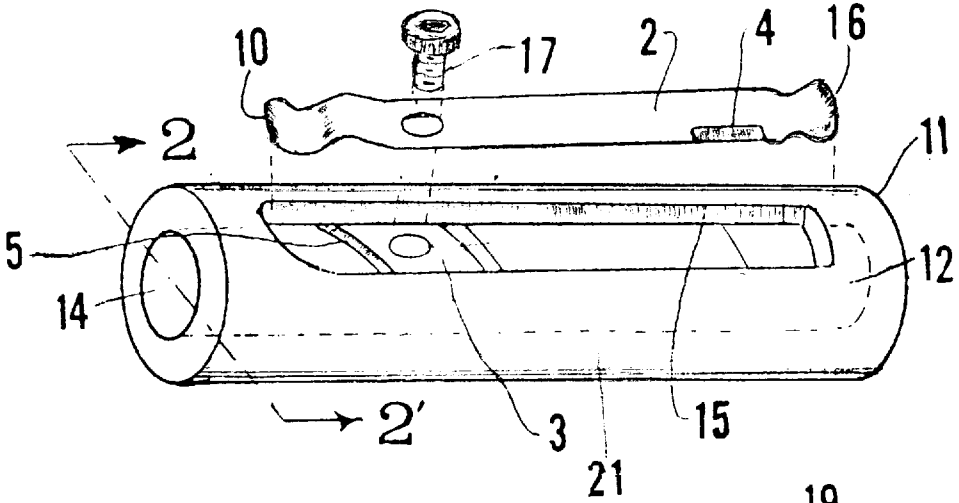
FIG. 1 is an isometric view of the invention partially disassembl showing the cutting edges, the insertion openings and the holding tangs.

2 are mounted into slot 15 by means of a bolt 17 and the threaded hole 21 as shown in FIG. 1. Steel bar 2 is bent at it ends into the tangs 10 and 16. With the bar in place the tangs will encounter tip 8 and ferrule 7 when the cue stick 6 is inserted in either opening 12 or 14.

Figure 2:
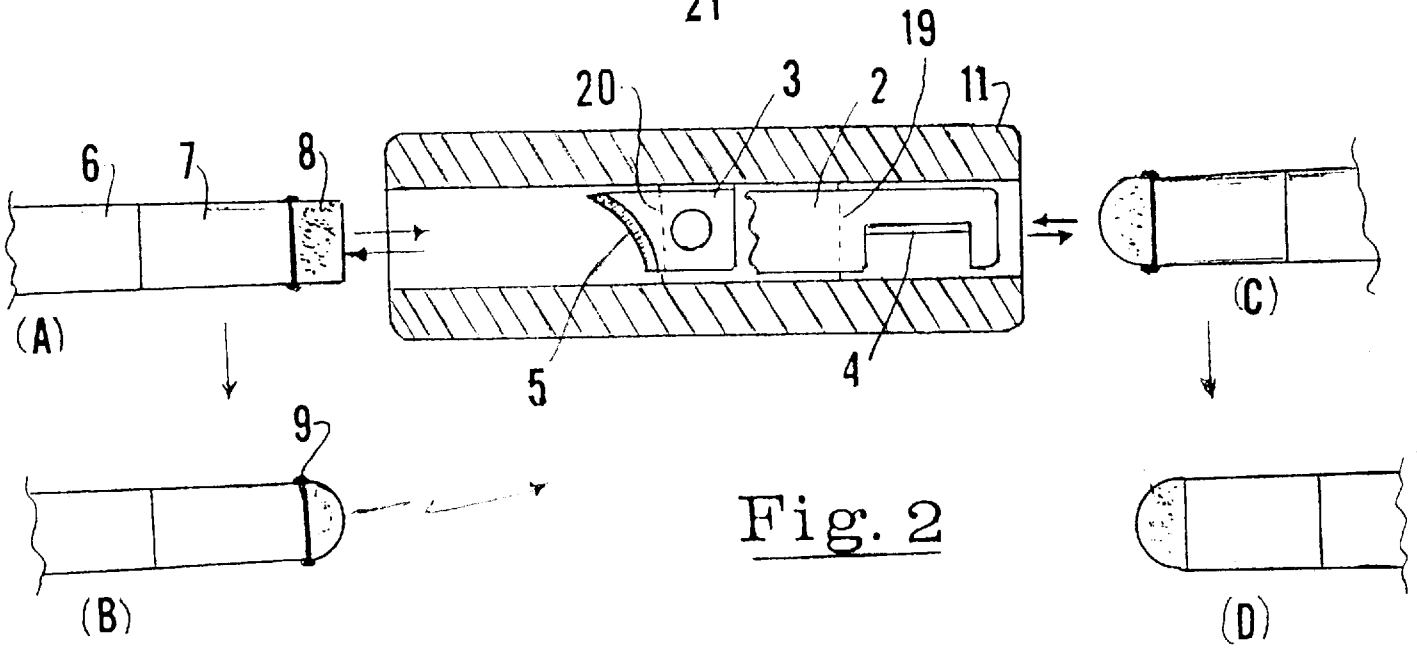
FIG. 2 is a cross section of the tool across line 2—2' of FIG. 1 with both cutting edges in place Also shown is a pool cue end as it is processed using both ends of the tool.

When a blank leather tip is cemented on a bare ferrule and the cement allowed to dry, it has the appearance shown in A of FIG. 2. A bead of excess cement 9 is present at the junction. Insertion of the cue stick end into the opening 14 causes the leather tip to come into contact with the curved cutting blade 5. Rotation of the stick now shapes the leather blank into the proper shape as in B of FIG. 2. Tang 10, which is pried back by the insertion of the stick end into opening 14, holds the tip firmly as the leather blank is being shaped. The cue stick end is next inserted into opening 12. The tang 16 is pried back by this insertion and holds the cue stick end firmly against the straight blade 4. Rotation of the stick now shaves away bead 9 and also trims the leather blank so that it is concentric with ferrule 7. The cue stick as in (D) of FIG. 2 is now ready for chalking and play.

Openings 12 and 14 are drilled to an accurately determined depth at each plane surface of cylinder 11. This provides the stops 19 and 20 to assure longitudinal positioning accuracy.

What is claimed is the following:

1. A compact tool for trimming and shaping tips of a billiard cue stick to which leather extensions have been cemented comprising:

a. a cylinder drilled to predetermined depths at its first and second ends;

b. a milled slot along one side of said cylinder;

c. a flexible steel bar with tanged-shaped terminations and with a ground-in lateral cutting edge, said bar being of a width to fit longitudinally along said milled slot;

d. a sharp blade with a curved cutting edge at one of its sides, the blade being of a width to fit transversely across said milled slot;

whereby insertion of a cue stick tip with a new extension into one of the drilled cylinder ends and rotation of the cue stick will trim any excess dried cement and out-of-round portions of the extension and subsequent insertion and rotation of the cue stick into the second cylinder end will shape the leather extension into a semi-circular form which is suitable for chalking and playing, both the trimming and shaping operation requiring a relatively short time.

2. A compact tool for trimming and shaping billiard cue stick tips as described in claim 1 in which the tang-shaped terminations are so arranged that any insertion of a cue stick tip into either end of the cylinder causes deflection of the corresponding termination producing spring pressure which holds said cue stick tip laterally firm inside either end of the cylinder.

3. A compact tool for trimming and shaping billiard cue stick tips as described in claim 1 in which said holding means for fastening the steel bar and the sharp blade are superimposed holes in the bar blade, a threaded hole in the body of the cylinder and a bolt or holding the assembly of the bar and blade firmly in position when tightened.

* * * * *